US011304007B2

(12) United States Patent
Sun et al.

(10) Patent No.: US 11,304,007 B2
(45) Date of Patent: Apr. 12, 2022

(54) LOUDSPEAKER DIAPHRAGM AND LOUDSPEAKER

(71) Applicant: GOERTEK INC., Shandong (CN)

(72) Inventors: Yajing Sun, Shandong (CN); Wentao Ma, Shandong (CN)

(73) Assignee: GOERTEK INC., Shandong (CN)

( * ) Notice: Subject to any disclaimer, the term of this patent is extended or adjusted under 35 U.S.C. 154(b) by 72 days.

(21) Appl. No.: 16/958,975

(22) PCT Filed: Oct. 25, 2018

(86) PCT No.: PCT/CN2018/111779
§ 371 (c)(1),
(2) Date: Jun. 29, 2020

(87) PCT Pub. No.: WO2019/128423
PCT Pub. Date: Jul. 4, 2019

(65) Prior Publication Data

US 2020/0344553 A1 Oct. 29, 2020

(30) Foreign Application Priority Data

Dec. 29, 2017 (CN) ..... 201711484550.5

(51) Int. Cl.
*H04R 25/00* (2006.01)
*H04R 7/18* (2006.01)
*H04R 9/06* (2006.01)

(52) U.S. Cl.
CPC ..... *H04R 7/18* (2013.01); *H04R 9/06* (2013.01)

(58) Field of Classification Search
CPC ..... H04R 7/18; H04R 9/06
(Continued)

(56) References Cited

U.S. PATENT DOCUMENTS 10,149,063 B2 12/2018 Watanabe et al.
2018/0367907 A1* 12/2018 Wu ..... H04R 7/127
2018/0367912 A1* 12/2018 Wu ..... H04R 7/127

FOREIGN PATENT DOCUMENTS

CN 1833464 A 9/2006
CN 101946525 A 1/2011
(Continued)

OTHER PUBLICATIONS

CN 205647941 U (English Translation). 2016—(Year: 2016).*
International Search Report from International Application No. PCT/CN2018/111779 dated Jan. 29, 2019.

*Primary Examiner* — Phylesha Dabney
(74) *Attorney, Agent, or Firm* — Brundidge & Stanger, P.C.

(57) ABSTRACT

An embodiment of the present invention provides a loudspeaker diaphragm and a loudspeaker. The loudspeaker diaphragm comprises: a center portion, a suspension ring portion, and a fixed portion successively connected from the inside to the outside; the diaphragm is provided thereon with a plurality of patterns that span across the suspension ring portion and the fixed portion; first ends of the patterns extend towards the peripheral edge of the fixed portion, while second ends thereof stretch towards the peripheral edge of the suspension ring portion so as to extend onto the suspension ring portion. The technical solution of the present invention can not only effectively disperse stress of a stress concentration region of the fixed portion, but also can increase the strength of the fixed portion, thus effectively avoiding the problem of warping deformation of the diaphragm after the diaphragm is molded, thereby improving the yield of the diaphragm.

9 Claims, 2 Drawing Sheets

(58) Field of Classification Search
USPC ..... 381/398
See application file for complete search history.

(56) References Cited

FOREIGN PATENT DOCUMENTS

| | | | |
|---|---|---|---|
| CN | 203086720 | U | 7/2013 |
| CN | 105050005 | A | 11/2015 |
| CN | 205249470 | U | 5/2016 |
| CN | 205647941 | U | 10/2016 |
| CN | 107948893 | A | 4/2018 |
| CN | 207665210 | U | 7/2018 |

* cited by examiner

LOUDSPEAKER DIAPHRAGM AND LOUDSPEAKER

TECHNICAL FIELD

The present invention belongs to the technical field of electro-acoustic conversion devices, particularly, the present invention relates to a loudspeaker diaphragm and a loudspeaker.

BACKGROUND ART

The loudspeaker is a device that can convert electric energy into acoustic energy, and is widely used in electronic apparatus such as mobile phones, computers, etc.

The diaphragm is the core sound-generating component of the loudspeaker, the diaphragm generally comprises a center portion, a suspension ring portion and a fixed portion, and the diaphragm is fixed on the housing of the loudspeaker by the fixed portion. At present, the design of the compliance performance of the diaphragm becomes more and more limited, therefore it is necessary to increase the width of the suspension ring portion by reducing the width of the fixed portion, so as to improve the compliance performance of the diaphragm. However, the design of the suspension ring portion may cause stress concentration on the fixed portion, and furthermore, the width of the fixed portion is reduced, as a results, it may easily cause warping deformation of the fixed portion at the outer side of the diaphragm, and affect the yield.

SUMMARY OF THE INVENTION

An object of the present invention is to avoid the problem of warping deformation of the diaphragm after the diaphragm is molded, so as to improve the yield of the diaphragm.

According to one aspect of the present invention, a loudspeaker diaphragm is provided. The loudspeaker diaphragm comprises a center portion, a suspension ring portion and a fixed portion which are sequentially connected from inside to outside; a plurality of patterns across the suspension ring portion and the fixed portion are provided on the diaphragm; first ends of the patterns extend towards the peripheral edge of the fixed portion, and second ends of the patterns protrude beyond the peripheral edge of the suspension ring portion to extend onto the suspension ring portion.

Preferably, the suspension ring portion comprises a main suspension ring and a auxiliary suspension ring which have opposite bending directions; the auxiliary suspension ring is connected between the main suspension ring and the fixed portion; the second ends of the patterns are positioned between the peripheral edge of the main suspension ring and the peripheral edge of the auxiliary suspension ring.

Preferably, protrusions of the patterns are provided at one side of the diaphragm, and protruding directions of the patterns are opposite to the bending direction of the auxiliary suspension ring.

Preferably, protruding heights of the patterns are less than or equal to 30 microns.

Preferably, each of the patterns has a strip shape, or each of the patterns has a zigzag line shape or a curve shape extending along surrounding directions of the fixed portion and the suspension ring portion.

Preferably, the patterns are V-shaped patterns, open ends of the V-shaped patterns are the first ends, and closed ends of the V-shaped patterns are the second ends.

Preferably, a plurality of the V-shaped patterns are evenly distributed on the diaphragm, and angle bisectors of several V-shaped patterns positioned on straight sides of the fixed portion are parallel to each other.

Preferably, the several V-shaped patterns positioned on the straight sides of the fixed portion are provided at equal intervals.

Preferably, the fixed portion has a rectangular shape, each of corners of the fixed portion is provided with one of the V-shaped patterns, which has an opening angle of 90°; and the several V-shaped patterns positioned on the straight sides of the fixed portion have opening angles of less than 90°.

According to another aspect of the present invention, a loudspeaker is provided. The loudspeaker comprises the loudspeaker diaphragm described above.

In the technical solution provided by the embodiments of the present invention, by means of providing a plurality of patterns across the suspension ring portion and the fixed portion on the diaphragm, not only the stress in the stress concentration region of the fixed portion can be effectively dispersed, but also the strength of the fixed portion can be increased, so as to effectively avoid the problem of warping deformation of the diaphragm after the diaphragm is molded, and improve the yield of the diaphragm.

Other features and advantages of the present invention will become clear by the following detailed description of exemplary embodiments of the present invention with reference to the accompanying drawings.

BRIEF DESCRIPTION OF THE DRAWINGS

The drawings constituting a part of the Specification describe embodiments of the present invention and are used to explain the principles of the present invention together with the description.

DETAILED DESCRIPTION OF EMBODIMENTS

Figure 1:
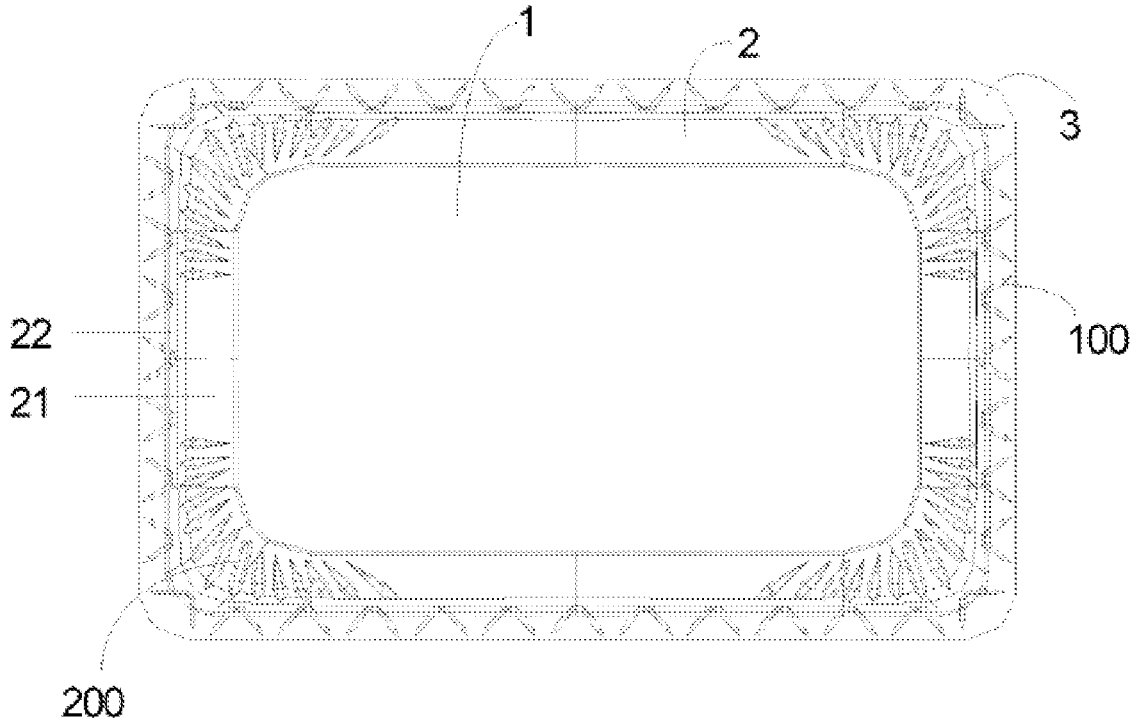
FIG. 1 is a schematic diagram of the structure of the loudspeaker diaphragm provided by an embodiment of the present invention in a first direction viewing angle.

Various exemplary embodiments of the present invention will now be described in detail with reference to the accompanying drawings. It should be noted that the relative arrangement, numerical expressions and numerical values of the components and the steps described in these embodiments do not limit the scope of the present invention, unless otherwise specified.

The following description of at least one exemplary embodiment is in fact illustrative only and in no way serves as any limitation to the present invention and the application or the use thereof.

The techniques and equipment known to those skilled in the art may not be discussed in detail, however, the techniques and equipment should be regarded as a part of the Specification as appropriate.

In all examples shown and discussed here, any specific value should be interpreted as only exemplary rather than as a limitation. Therefore, other examples of exemplary embodiments may have different values.

It should be noted that similar reference numerals and letters indicate similar items in the following drawings, therefore, once an item is defined in one drawing, further discussion on the item is not necessary in the subsequent drawings.

FIG. 1 is a schematic diagram of the structure of the loudspeaker diaphragm provided by an embodiment of the present invention in a first direction viewing angle. As shown in FIG. 1, the loudspeaker diaphragm comprises a center portion 1, a suspension ring portion 2 and a fixed portion 3 which are sequentially connected from inside to outside; a plurality of patterns 100 across the suspension ring portion 2 and the fixed portion 3 are provided on the diaphragm; first ends of the patterns 100 extend towards the peripheral edge of the fixed portion 3, and the second ends of the patterns 100 protrude beyond the peripheral edge of the suspension ring portion 2 to extend onto the suspension ring portion 2.

Wherein, each of the patterns 100 may have a groove structure or a protrusion structure, and may have a strip shape, or each of the patterns has a zigzag line shape or a curve shape which extends along surrounding directions of the fixed portion and the suspension ring portion, for example, a V shape or a W shape, and the shape is not specifically limited in this embodiment.

In the technical solution provided by the embodiments of the present invention, by means of providing a plurality of patterns across the suspension ring portion and the fixed portion on the diaphragm, not only the stress in the stress concentration region of the fixed portion can be effectively dispersed, but also the strength of the fixed portion can be increased, so as to effectively avoid the problem of warping deformation of the diaphragm after the diaphragm is molded, and improve the yield of the diaphragm. It should be noted that since the stress in the fixed portion generates and originates from the suspension ring portion, therefore, the stress onto the fixed portion caused by the suspension ring portion can be effectively reduced by extending one end of the pattern onto the suspension ring portion.

Figure 2:
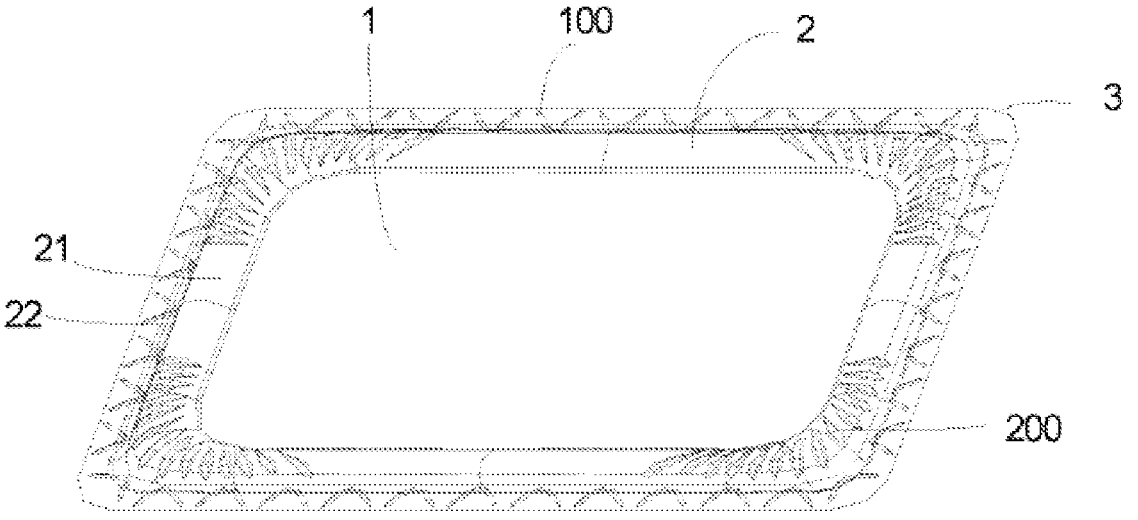
FIG. 2 is a schematic diagram of the structure of the loudspeaker diaphragm provided by an embodiment of the present invention in a second direction viewing angle.
Figure 3:
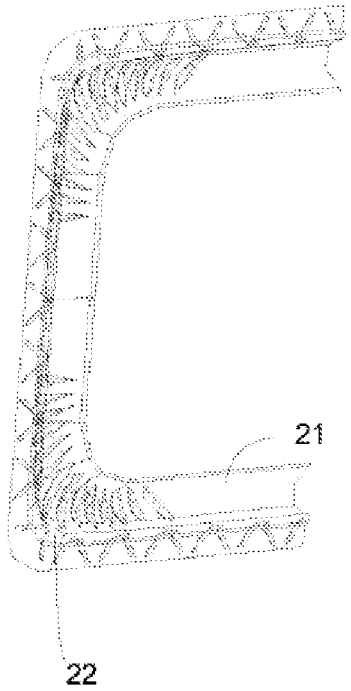
FIG. 3 is a partial schematic diagram of the loudspeaker diaphragm provided by an embodiment of the present invention.
Figure 4:
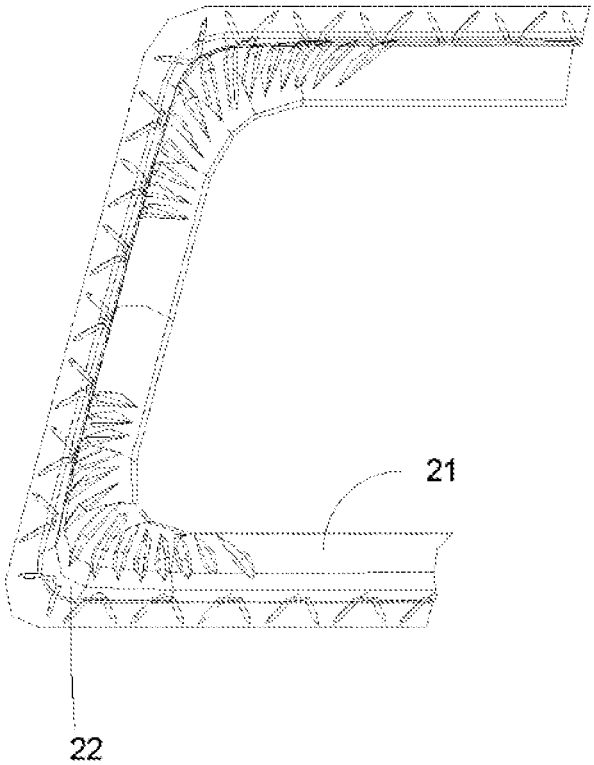
FIG. 4 is another partial schematic diagram of the loudspeaker diaphragm provided by an embodiment of the present invention.

Furthermore, in order to further improve the performance of the vibration region, a auxiliary suspension ring having an bending direction opposite to the bending direction of the main suspension ring may be provided at a position adjacent to the main suspension ring to increase the height of the suspension ring, so as to enhance the strength of the suspension ring of the diaphragm and reduce the effect of distortion. Considering that the arranging of the auxiliary suspension ring may cause the stress in the fixed portion excessively concentrated, and the stress releases after cutting, as a result, it is easy to cause warping deformation of the fixed portion outside the diaphragm and affect the yield of the diaphragm. Therefore, in order to avoid the problem of excessive concentration of the stress in the fixed portion caused by arranging the auxiliary suspension ring, the following methods may be adopted, as shown in FIG. 2, FIG. 3 and FIG. 4, the suspension ring portion 2 comprises a main suspension ring 21 and a auxiliary suspension ring 22 which have opposite bending directions; the auxiliary suspension ring 22 is connected between the main suspension ring 21 and the fixed portion 3; the second ends of the patterns 100 are positioned between the peripheral edge of the main suspension ring 21 and the peripheral edge of the auxiliary suspension ring 22. In this embodiment, the patterns 100 are configured across the fixed portion 3 and the auxiliary suspension ring 22, so that the stress in the stress concentration region of the fixed portion can be effectively dispersed. It should be noted that since the stress in the fixed portion generates and originates from the auxiliary suspension ring, therefore the stress onto the fixed portion caused by the auxiliary suspension ring can be effectively reduced by extending one end of the pattern onto the auxiliary suspension ring. In addition, the arranging of the patterns 100 has a certain supporting effect on the auxiliary suspension ring 22, which further optimizes the acoustic performance of the diaphragm. In practice, the height of the curved surface of the auxiliary suspension ring 22 is smaller than the height of the curved surface of the main suspension ring 21.

It should be noted that a plurality of auxiliary suspension rings may be provided between the main suspension ring 2 and the fixed portion 3, the bending direction of the main suspension ring 2 is opposite to the bending directions of any two adjacent suspension rings of the plurality of auxiliary suspension rings, and the second ends of the patterns 100 are positioned on the auxiliary suspension rings adjacent to the fixed portion 3 among the plurality of auxiliary suspension rings. In addition, at least one auxiliary suspension ring may be provided between the main suspension ring 21 and the center portion 1. By means of the arranging of the plurality of suspension rings, a wave shaped suspension ring region is formed, therefore the linear range of compliance of the diaphragm is widened to a greater extent, and the acoustic performance of the diaphragm is improved.

Considering that the direction of the stress onto the fixed portion 3 caused by arranging the auxiliary suspension ring 22 is opposite to the bending direction of the auxiliary suspension ring 22, therefore, as shown in FIG. 2, the protrusions of the patterns 100 may be provided at one side of the diaphragm; the protruding directions of the patterns 100 are opposite to the bending direction of the auxiliary suspension ring 22. In this way, the warping deformation of the fixed portion under the action of stress can be prevented, and the yield of diaphragm can be further improved.

The protruding heights of the above-described patterns 100 should not be too high, so as not to affect the sealing of the front and rear cavities. Particularly, the protruding heights of the patterns 100 are less than or equal to 30 microns. The particular height may be set according to the shape and size of the diaphragm.

In a preferred embodiment, the patterns 100 are V-shaped patterns; the open ends of the V-shaped patterns are the first ends, and the closed ends of the V-shaped patterns are the second ends. Since the closed end of the V-shaped pattern has a triangular shape, therefore effective support can be provided for the suspension ring portion 2, especially for the auxiliary suspension ring 22.

In an implementable solution, as shown in FIG. 2, a plurality of the V-shaped patterns are evenly distributed on the diaphragm, and angle bisectors of several V-shaped patterns positioned on straight sides of the fixed portion 3 are parallel to each other. Preferably, the angular bisectors of the several V-shaped patterns located on the straight sides of the fixed portion 3 are perpendicular to the peripheral edge of the suspension ring portion 2. In addition, the several V-shaped patterns located on the straight sides of the fixed portion 3 may be provided at equal intervals or provided at unequal intervals.

The diaphragm may have an elliptical shape, a rectangular shape or a runway shape, etc., that is, the center portion 1, the suspension ring portion 2 and the fixed portion 3 may have an elliptical shape, a rectangular shape or a runway shape, etc., the embodiments of the present invention does not specifically define the shape, and those skilled in the art may choose a shape according to the actual situation.

Furthermore, as shown in FIG. 2, the diaphragm has a rectangular shape, and each of the corners of the main suspension ring 21 is provided with a reinforcing pattern area 200, and the arranging of the reinforcing pattern area 200 can effectively enhance the stability of the diaphragm, reduce polarization and improve the acoustic performance of the diaphragm.

FIG. 1 shows a diaphragm having a rectangular structure, the fixed portion 3 of the diaphragm comprises two groups of straight sides and the corners connecting the adjacent straight sides, and the corners of the fixed portion 3 correspond to the corners of the suspension ring portion 2. As shown in FIG. 1, the fixed portion 3 has a rectangular shape; each of the corners of the fixed portion 3 is provided with one of the V-shaped patterns, which has an opening angle of 90°; and the several V-shaped patterns positioned on the straight sides of the fixed portion 3 have opening angles of less than 90°. Of course, the above descriptions are limited to the further detailed descriptions of this embodiment, and are not used to limit the present invention. In the specific implementation, the details such as the shape, the interval and the arrangement of the patterns 100, as well as the number and the angle of the patterns at the corners of the fixed portion and the like are not limited by the above descriptions, and the actual adjustment may be made according to the specific diaphragm structure and the performance requirements of the product.

According to another aspect of the present invention, a loudspeaker is further provided, and the loudspeaker comprises the loudspeaker diaphragm in any of the above embodiments. Wherein, as for the specific implementation of the loudspeaker diaphragm, it may refer to the relevant contents in the above embodiments, and will not be described here.

According to another aspect of the present invention, an electronic apparatus is further provided, and the electronic apparatus comprises the above loudspeaker. The electronic apparatus comprises but is not limited to mobile phones, tablet computers, MP3, etc.

Although some specific embodiments of the present invention have been described in detail through examples, it should be understood by those skilled in the art that the above examples are used for illustrative purposes only and are not intended to limit the scope of the present invention. It should be understood by those skilled in the art that the above embodiments can be modified without departing from the scope and spirit of the present invention. The scope of the present invention is defined by the appended claims.

What is claimed is:

1. A loudspeaker diaphragm, comprising a center portion, a suspension ring portion and a fixed portion which are sequentially connected from inside to outside, wherein a plurality of patterns across the suspension ring portion and the fixed portion are provided on the loudspeaker diaphragm, first ends of the patterns extend towards a peripheral edge of the fixed portion, and second ends of the patterns protrude beyond a peripheral edge of the suspension ring portion to extend onto the suspension ring portion, and wherein the patterns are V-shaped patterns, open ends of the V-shaped patterns are the first ends, and closed ends of the V-shaped patterns are the second ends.

2. The loudspeaker diaphragm according to claim 1, wherein the suspension ring portion comprises a main suspension ring and a auxiliary suspension ring which have opposite bending directions, the auxiliary suspension ring is connected between the main suspension ring and the fixed portion, and the second ends of the patterns are positioned between a peripheral edge of the main suspension ring and a peripheral edge of the auxiliary suspension ring.

3. The loudspeaker diaphragm according to claim 2, wherein protrusions of the patterns are provided at one side of the loudspeaker diaphragm, and protrusions directions of the patterns are opposite to bending direction of the auxiliary suspension ring.

4. The loudspeaker diaphragm according to claim 3, wherein heights of the protrusions of the patterns are less than or equal to 30 microns.

5. The loudspeaker diaphragm according to claim 1, wherein each of the patterns has a strip shape, or each of the patterns has a zigzag line shape or a curve shape extending along surrounding directions of the fixed portion and the suspension ring portion.

6. The loudspeaker diaphragm according to claim 1, wherein a plurality of the V-shaped patterns are evenly distributed on the loudspeaker diaphragm, and angle bisectors of several V-shaped patterns positioned on straight sides of the fixed portion are parallel to each other.

7. The loudspeaker diaphragm according to claim 6, wherein the several V-shaped patterns positioned on the straight sides of the fixed portion are provided at equal intervals.

8. The loudspeaker diaphragm according to claim 6, wherein the fixed portion has a rectangular shape, a corner of the fixed portion is provided with one of the V-shaped patterns, which has an opening angle of 90°, and the several V-shaped patterns positioned on the straight sides of the fixed portion have opening angles of less than 90°.

9. A loudspeaker, comprising the loudspeaker diaphragm according to claim 1.

* * * * *